US005100140A

United States Patent [19]

Foy

[11] Patent Number: 5,100,140

[45] Date of Patent: Mar. 31, 1992

[54] WHEEL OF BLACK HISTORY GAME DEVICE

[76] Inventor: Frank E. Foy, 5011-57th Ave. So., Seattle, Wash. 98118

[21] Appl. No.: 583,938

[22] Filed: Sep. 18, 1990

[51] Int. Cl.[5] ..... A63F 5/04

[52] U.S. Cl. ..... 273/142 R; 273/142 HA; 273/142 H

[58] Field of Search ..... 273/138 R, 138 A, 139, 273/141 R, 142 R, 142 H, 142 HA

[56] References Cited

U.S. PATENT DOCUMENTS

| | | | |
|---|---|---|---|
| 1,689,326 | 10/1928 | Garzie | 273/142 R |
| 2,454,479 | 11/1948 | Rosenberger | 273/141 R |
| 2,565,557 | 8/1951 | Guimond | 273/142 HA |
| 3,232,622 | 2/1966 | Lambert | 273/141 A |
| 3,804,419 | 4/1974 | Jackson | 273/142 HA |
| 3,841,637 | 10/1974 | Piazza et al. | 273/141 A |
| 4,116,449 | 9/1978 | Breslow | 273/142 R |

FOREIGN PATENT DOCUMENTS

| | | | |
|---|---|---|---|
| 1478252 | 4/1969 | Fed. Rep. of Germany | 273/141 R |

*Primary Examiner*—Edward M. Coven
*Assistant Examiner*—Raleigh W. Chiu

[57] ABSTRACT

A primarily African and African-American history education game device for several players having a stationary disc base with pins for alternately mounting two concentric rows of movable slot cards. Educational subject matter is inscribed on slot cards. Supported on the base is a smaller rotating disc having one radially located opening pointer to expose the "start" position at the start of a game and subject matter on slot cards mounted on the base smaller diameter concentric row when rotated. When the locking pin locks the smaller rotating disc relative to the base the rotating disc conceals all slot card subject matter and exposes the "start" position. No slot cards are in the exposed larger diameter concentric row when the rotating disc opening exposes the "start" position. The game device structure according to my invention allows the provision of a chance device for establishing player spinning order and for numerous movable slot cards which contain the subject matter of the game to be individually moved from the smaller diameter concentric row on the bases to the exposed larger diameter concentric row on the base when game is in progress. Moved slot cards are not repositioned on the smaller diameter concentric row during the game. When all slot cards are moved to the exposed larger diameter.

2 Claims, 3 Drawing Sheets

WHEEL OF BLACK HISTORY GAME DEVICE

BACKGROUND OF THE INVENTION

1. Field of the Invention

The present invention relates to an educational game device for several players and is useful in learning world and national history. The game is primarily directed toward an educational device in which several players compete and enhance their knowledge about African and African-American history. The game is particularly useful for aiding the cultural education of a wide cross-section of people and provides a means for making learning about African and African-American history fun, stimulating, and interesting.

2. Description of Prior Art

Many game devices particularly spinner game devices have been provided for amusement and education about a range of subjects, including African and African-American history, for children and adults. I am not aware of a game that enhances learning about African and African-American history by using movable slot cards inscribed with names, words, numbers, and letters in the form of educational subject matter on the stationary disc base to reinforce the level of knowledge and education about the game's subject at the end of the game.

OBJECTS

It is an object of the present invention to provide a new educational game device for several players which holds the interest of the players and make learning about African and African-American history fun and stimulating throughout the game.

Another object of the present invention is provide a means to reinforce the level of learning and stimulate added discussions about African and African-American history after the game by having all slot cards inscribed with educational subject matter exposed on the stationary disc base at the end of the game.

Another object of the game is to conceal subject matter before the game commences by inserting pin locking rotating disc relative to the stationary disc base.

DRAWINGS REFERENCE NUMERIALS

10—stationary disc base
12—mounting pins
14—slot card slot
16—start slot
18—small diameter row
20—hole
22—rotating disc
24—opening pointer
26—spinning knob
28—direction arrow
30—mounting hole
32—locking pin
34—shaft
36—slot card
38—subject matter

WHEEL OF BLACK HISTORY GAME DEVICE—DESCRIPTION

Figure 1:
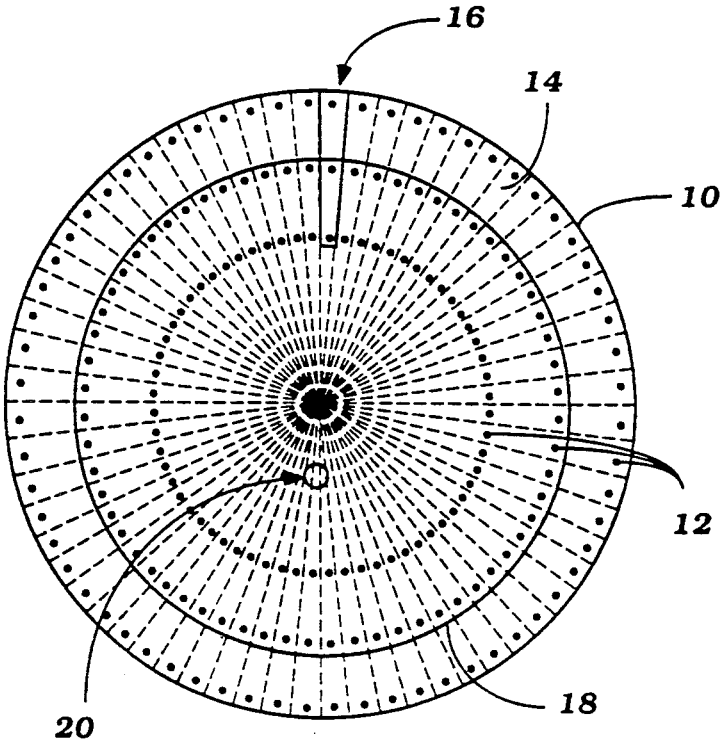
FIG. 1 is a plan view of the stationary disc base showing pins for alternately mounting two concentric rows of movable slot cards in accordance with the present invention.
Figure 5:
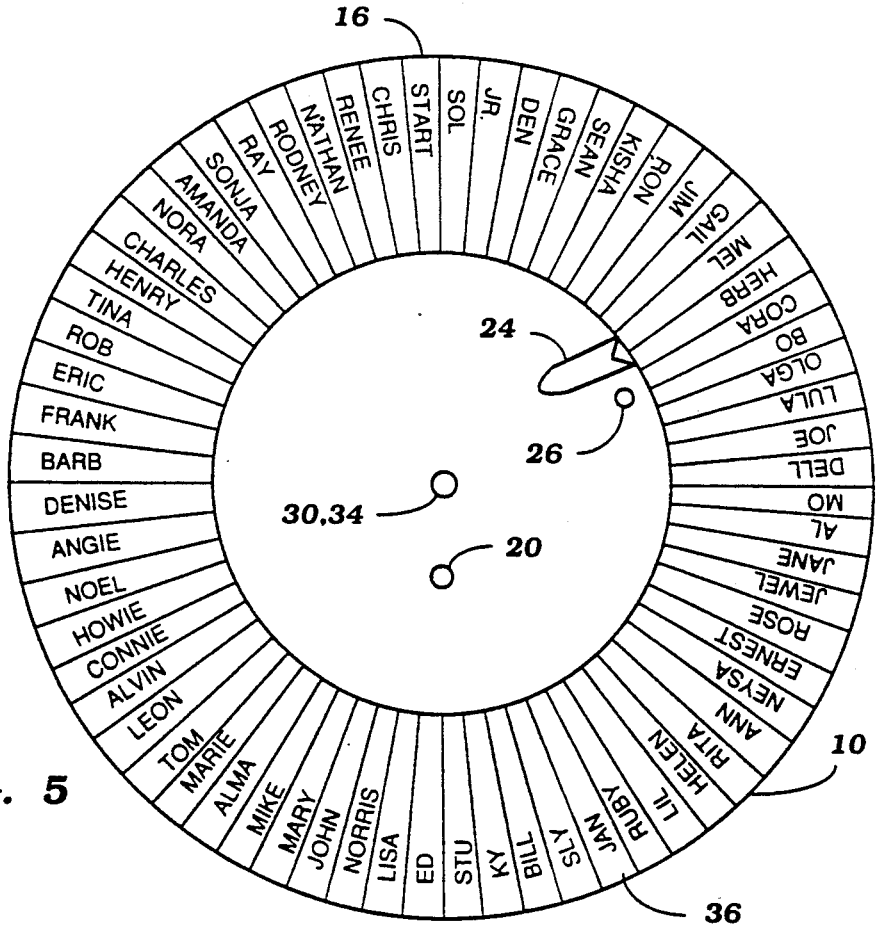
FIG. 5 is an plan view of the assembled game device showing all slot cards in the exposed larger concentric row.
Figure 6:
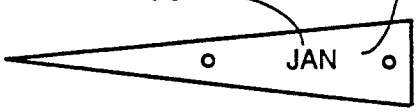
FIG. 6 is an enlarged view of a slot card inscribed with subject matter.

FIG. 1 is a plan view of the stationary disc base 10 in accordance with the present invention. The base 10 will be heavy enough to provide suitable stability and sturdiness for mounting on a flat surface or on an appropriate bracket. The base 10 has molded in its surface approximate 1/16" long pins 12 used for alternately mounting slot cards 36 shown in FIGS. 5 and 6 in two concentric rows. The approximate $\frac{1}{8}$" thick and approximate $13\frac{3}{4}$" diameter base 10 is preferably suited for 65 slot card slots 14 and one "start" slot 16. The smaller diameter circle 18 is the outline formed when all slot cards 36 shown in FIGS. 5 and 6 are mounted at the start of a game. A chance device is used to establish the order the several players spin the rotating disc 22. The first player to spin in the game will always begin with the rotating disc opening pointer 24 in FIG. 2 in the "start" position slot 16 shown in FIG. 3. The shaft 34, shown in FIG. 4, of base 10 is approximately $\frac{1}{2}$" long and $\frac{1}{8}$" in diameter. It is preferably molded in base 10 and can be threaded or smooth to fit the most suitable mounting of the rotating disc 22 shown in FIG. 2. The approximate 1/16" diameter hole 20 in base 10 and in the rotating disc 22 in FIG. 2 is used to keep the rotating disc 22 in the "start" position by inserting pin 32 as shown in FIG. 4.

Figure 2:
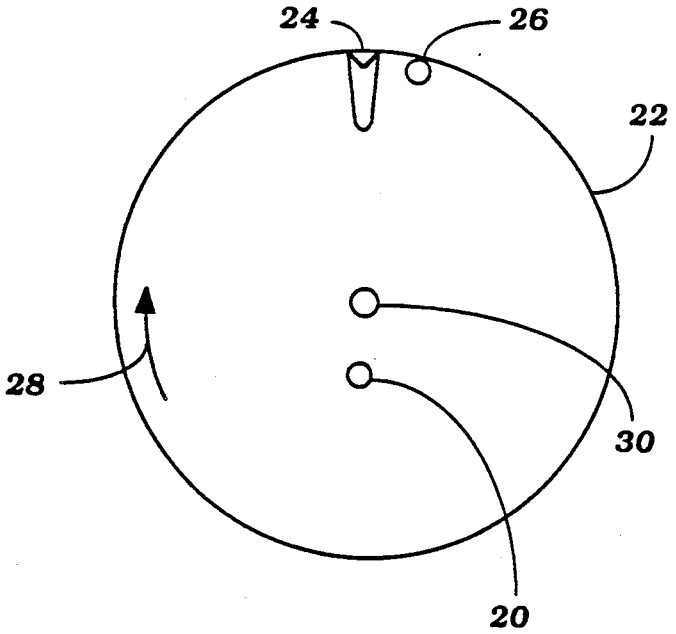
FIG. 2 is a plan view of the rotating disc having one radial opening pointer in accordance with the present invention.

FIG. 2 is a plan view of the rotating disc 22 having a radial opening pointer in accordance with the present invention. The rotating disc 22 is approximately $\frac{1}{8}$" thick and has an approximate $10\frac{3}{4}$" diameter and will be heavy enough to provide suitable stability and sturdiness when mounted on base 10 shown in FIG. 1. The rotating disc 22 includes an opening pointer 24 used for exposing and viewing slot cards 36 as shown in FIGS. 5 and 6 when the disc comes to rest after being rotated. The small turning knob 26 is used for spinning the rotating disc in the direction of the arrow 28. The shaft mounting hole 30 is molded for mounting as shown in FIG. 4 or other suitable mounting arrangements that provide stability in the spinning mode.

Figure 3:
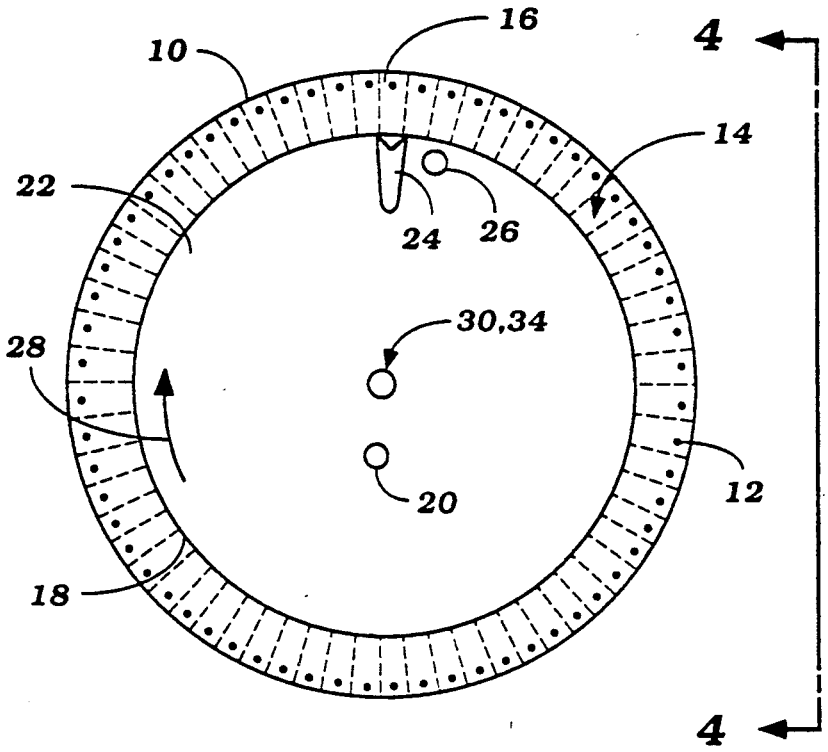
FIG. 3 is a plan view of the prefabricated Wheel Of Black History Game Device assembled showing slot cards concealed by the rotating disc and opening pointer exposing the "start" position. No slot cards are on the exposed larger concentric row.

FIG. 3 is a plan view of the stationary disc base 10 and the rotating disc 22 assembled to make the Wheel Of Black History Game Device in accordance with the present invention. The assembled slot cards mounted on the smaller diameter concentric row are concealed by the rotating disc when in the "start" position. No slot cards are in the larger diameter concentric row at the start of a game.

Figure 4:
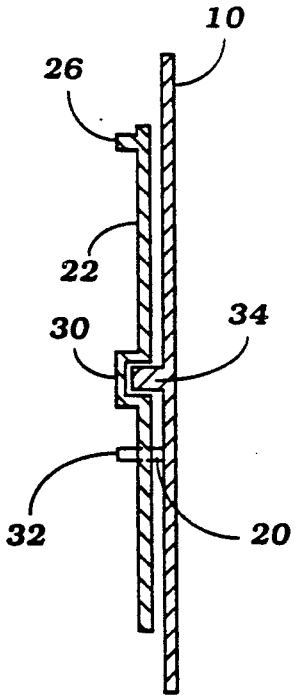
FIG. 4 is a sectional view of the assembled game device taken from FIG. 3.

FIG. 4 is a sectional view, taken at section 1A—1A of FIG. 3, of the completely assembled game device in accordance with this invention. This view shows one method of mounting the rotating disc 22 using the mounting hole 30 over the non-threaded shaft 34.

FIG. 5 is an plan view of the assembled game device with all slot cards inscribed with subject matter mounted in the exposed larger diameter concentric row 18 on the stationary disc base 10. The movement of slot cards 36 from the smaller diameter concentric row on base 10 shown in FIG. 7 to the exposed larger diameter concentric row on base 10 FIG. 5 assures slot card subject matter will be exposed by the opening pointer only once during the current game.

FIG. 6 is an enlarged plan view of a typical slot card 36. These cards are prefabricated from the same or similar material used for the stationary disc base 10 and the rotating disc 22. The subject matter 38 will be inscribed on the slot cards 36 that are approximately 2⅜" long and approximately ½" at its base and is about ⅛" thick.

Figure 7:
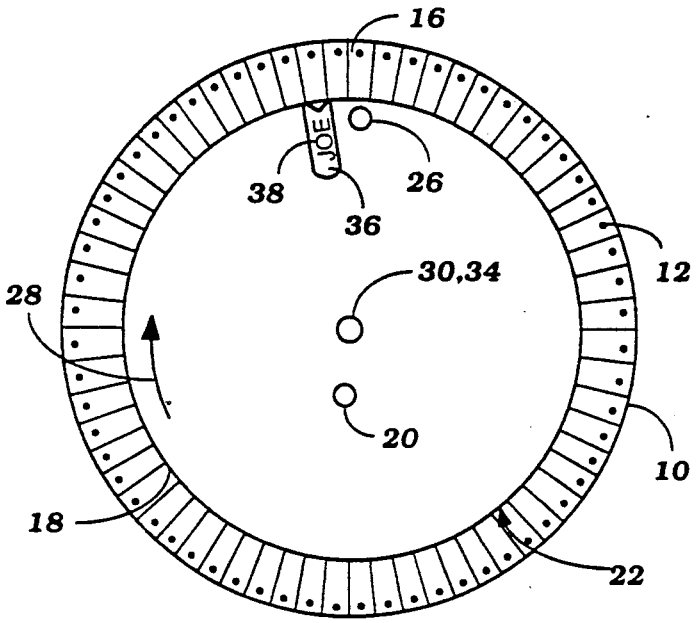
FIG. 7 is an plan view of the assembled game device showing the rotating disc opening pointer exposing typical subject matter on one slot card.

FIG. 7 is a plan view of the assembled game device showing rotating disc 22 stopped with subject matter 38 showing in the radial opening pointer 24. The opening pointer exposes Joe as the person selected by the spinner who must recite the correct response to score points. The slot card with Joe inscribed is moved to the exposed larger diameter concentric row shown in FIG. 5. Slot cards moved to the larger diameter concentric row are not moved back to the smaller concentric row during the game. Slot cards not selected during the spin process are always concealed by the rotating disc. The spin process is continued until all slot cards are moved to the larger diameter concentric row.

WHEEL OF BLACK HISTORY GAME DEVICE—OPERATION

The user of the device mounts slots cards inscribed with subject matter 36 in FIGS. 5 and 6 on the smaller diameter concentric row 18 on stationary disc base 10 shown in FIG. 1. The user will not mount a slot card on the stationary disc base slot 16 marked with the word "start".

After the user mounts all slot cards on the stationary disc base, the user mounts rotating disc 22 shown in FIG. 2 on shaft 34 shown in FIG. 4 and insert pin 32 in FIG. 4 into hole 20 shown in FIGS. 1 and 2.

After the device is assembled as shown in FIG. 3, the user uses a chance device to establish the starting order of several players. The first player uses the knob 26 shown in FIG. 3 to spin the rotating disc in the direction of arrow 28 in FIG. 4. When the rotating disc stops the opening pointer 24 in FIG. 2 exposes subject matter 38 shown in FIG. 7 for which the spinning player must recite the correct response to score points. After the subject matter is exposed the user moves the slot card inscribed with the subject matter to the larger diameter concentric row shown in FIG. 5. Once moved, slot cards are not moved by to the smaller concentric row. The spinning process continues until all slot cards subject matter is exposed by the opening pointer and moved to the larger diameter concentric row shown in FIG. 5.

I claim:

1. An educational game device useful in learning world and natural history comprising a stationary disc base having a plurality of slot cards inscribed with educational subject matter arranged in a concentric row, said slot cards are movable from a concealed smaller diameter position to an exposed larger diameter position, a rotatable circular full window pointer having one radially located window wherein slot cards can be individually moved from the concealed smaller diameter position to the exposed larger diameter position and said slot cards not selected by said pointer are concealed from view.

2. A game device as in claim 1 further comprising means to lock said rotatable window pointer relative to said stationary disc base in a "start" position.

* * * * *